US009644303B2

(12) United States Patent
Lee et al.

(10) Patent No.: US 9,644,303 B2
(45) Date of Patent: May 9, 2017

(54) WALL-MOUNTED DRUM WASHING APPARATUS

(71) Applicant: Dongbu Daewoo Electronics Corporation, Seoul (KR)

(72) Inventors: Ju Dong Lee, Incheon (KR); Ui Kun Hwang, Bucheon-si (KR); Man Ki Kim, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 98 days.

(21) Appl. No.: 14/019,461

(22) Filed: Sep. 5, 2013

(65) Prior Publication Data

US 2014/0076005 A1 Mar. 20, 2014

(30) Foreign Application Priority Data

Sep. 14, 2012 (KR) ..... 10-2012-0101985

(51) Int. Cl.
*D06F 37/26* (2006.01)
*D06F 39/12* (2006.01)

(52) U.S. Cl.
CPC ..... *D06F 37/26* (2013.01); *D06F 39/12* (2013.01); *D06F 39/125* (2013.01)

(58) Field of Classification Search
None
See application file for complete search history.

(56) References Cited

U.S. PATENT DOCUMENTS 4,270,821 A * 6/1981 Verdesca ..... A47B 95/008 248/224.8
4,462,225 A * 7/1984 Noe ..... 68/3 R
4,752,010 A * 6/1988 Holztrager ..... 211/90.02
7,587,917 B2 * 9/2009 Gilboe et al. ..... 68/240
2005/0116134 A1 * 6/2005 Lee ..... D06F 37/20 248/650

FOREIGN PATENT DOCUMENTS

EP 1205129 A1 * 5/2002 ..... A47B 47/042
EP 2412861 * 2/2012 ..... D06F 25/00
WO WO 2011051184 A1 * 5/2011

* cited by examiner

*Primary Examiner* — Michael Barr
*Assistant Examiner* — Cristi Tate-Sims

(57) ABSTRACT

A wall-mounted drum washing apparatus includes: a wall-mounted drum washing machine; and an installation stand formed to extend upward from a floor and contacted with a floor and a wall. The wall-mounted drum washing machine is mounted on the installation stand.

9 Claims, 18 Drawing Sheets

WALL-MOUNTED DRUM WASHING APPARATUS

CROSS-REFERENCES TO RELATED APPLICATIONS

The present application claims priority to Korean application number 10-2012-0101985, filed on Sep. 14, 2012, which is incorporated by reference in its entirety.

BACKGROUND OF THE INVENTION

The present invention relates to a wall-mounted drum washing apparatus, and more particularly, to a wall-mounted drum washing apparatus including a wall-mounted drum washing machine mounted thereon.

A general wall-mounted drum washing machine includes a cabinet, a tub movably installed in the cabinet and containing water therein, a drum rotatably installed in the tub and housing laundry therein, a driving unit to provide power to the drum, a water supply device supplying wash water to the tub, and a drain device discharging wash water from the tub to the outside of the cabinet.

When a user puts laundry into the drum and starts a washing process, wash water is supplied into the tub and the drum by operation of the water supply device. As the drum is rotated by the operation of the driving unit, the washing process is started.

After the washing process is ended, the wash water having been contained in the tub and the drum is discharged to the outside of the cabinet through the drain device by operation of the drain device.

The related art of the present invention has been disclosed in Utility Model Registration Notification No. 20-0305578 published on Feb. 26, 2003 and titled "Wall-mounted small drum washing machine".

The conventional wall-mounted drum washing machine is installed to hang on a bracket fixed to a wall. However, a coupling force between the bracket and the wall may differ depending on the material and shape of the wall.

That is, the installation stability of the wall-mounted drum washing machine may differ depending on the installation environment of the wall-mounted drum washing machine.

In particular, when the wall is finished with plaster, the bracket cannot be reliably fixed to the wall. In this case, the wall-mounted drum washing machine cannot be installed.

Thus, there is a demand for a structure capable of solving such a problem.

SUMMARY OF THE INVENTION

Embodiments of the present invention are directed to a wall-mounted drum washing apparatus capable of stably installing a wall-mounted drum washing machine regardless of the material and shape of a wall structure.

In one embodiment, a wall-mounted drum washing apparatus includes: a wall-mounted drum washing machine; and an installation stand formed to extend upward from a floor and contacted with a floor and a wall. The wall-mounted drum washing machine is mounted on the installation stand.

The wall-mounted drum washing machine may include: a rear panel fixed to the installation stand; a tub supported by the rear panel and containing wash water; a drum rotatably installed in the tub; a driving unit providing power to the drum; a front panel having an opening formed therein and installed on the tub; a cover installed on the rear panel and covering the tub and the front panel; a water supply device supplying wash water to the tub; and a drain device discharging wash water from the tub to the outside.

The installation stand may include: a lower support portion contacted with the floor; and an upper support portion connected to the lower support portion, formed to extend upward from the lower support portion, and disposed in contact with the wall, and the wall-mounted drum washing machine is mounted on the upper support portion.

The upper support portion may include: a plurality of vertical bars connected to the lower support portion at the bottom thereof and formed to extend upward; and a plurality of connection bars connecting the plurality of vertical bars.

The upper support portion may include an upper support panel connected to the lower support portion at the bottom thereof and formed to extend upward.

The upper support portion may include: a plurality of coupling grooves formed in a concave shape in the upper support panel; and a tray inserted and coupled to a part of the coupling grooves and containing laundry or detergent.

The plurality of coupling grooves may be formed in a vertical direction over the upper support panel, and the tray may be selectively inserted and coupled to a part of the plurality of coupling grooves such that an installation position of the tray is changed over the upper support panel.

The upper support portion may include a fixing anchor formed to protrude from a front surface thereof, which is contacted with the wall-mounted drum washing machine, toward a front side and inserted into the rear panel of the wall-mounted drum washing machine.

A front end of the fixing anchor passing through the rear panel may be coupled to a nut member, thereby fixing the wall-mounted drum washing machine on the installation stand.

The installation stand may further include an adhesive coupling layer formed on one or more of a bottom surface of the lower support portion, which is contacted with the floor, and a rear surface of the upper support portion, which is contacted with the wall, and forming an adhesive surface on which an adhesive is attached.

The installation stand may further include a buffer member coupled to one or more of a bottom surface of the lower support portion, which is contacted with the floor, and a rear surface of the upper support portion, which is contacted with the wall, and absorbing vibrations of the wall-mounted drum washing machine.

The installation stand may further include an angle control unit controlling an angle between the lower support portion and the upper support portion according to a gradient of a floor.

The angle control unit may include: a hinge pin installed through the lower support portion and the upper support portion; and a fixing member coupled to an end of the hinge pin and blocking the hinge pin from coming off from the lower support portion and the upper support portion.

DESCRIPTION OF SPECIFIC EMBODIMENTS

Hereinafter, exemplary embodiments of the present invention will be described in detail with reference to the accompanying drawings.

The drawings are not necessarily to scale and in some instances, proportions may have been exaggerated in order to clearly illustrate features of the embodiments.

Furthermore, terms to be used in this disclosure are defined in consideration of functions in the present invention, and may be defined differently depending on the intention or practice of a user or operator. Thus, the terms must be defined on the basis of the overall content of the disclosure.

Figure 1:
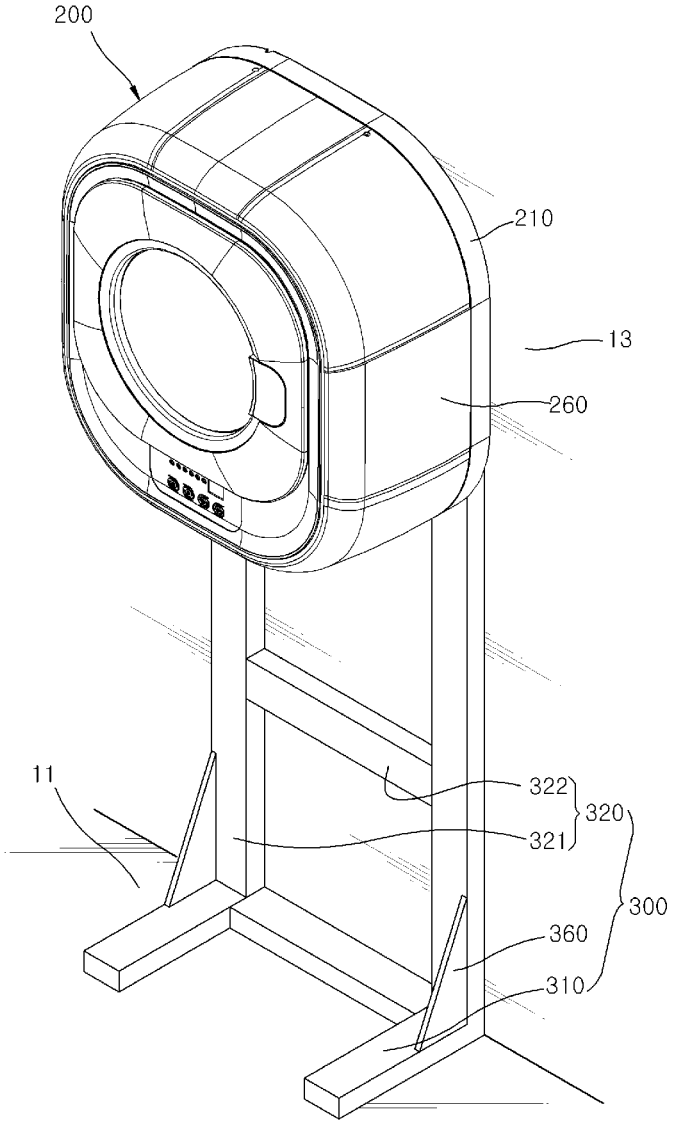
FIG. 1 is a perspective view illustrating an installation state of a wall-mounted drum washing apparatus in accordance with a first embodiment of the present invention.
Figure 2:
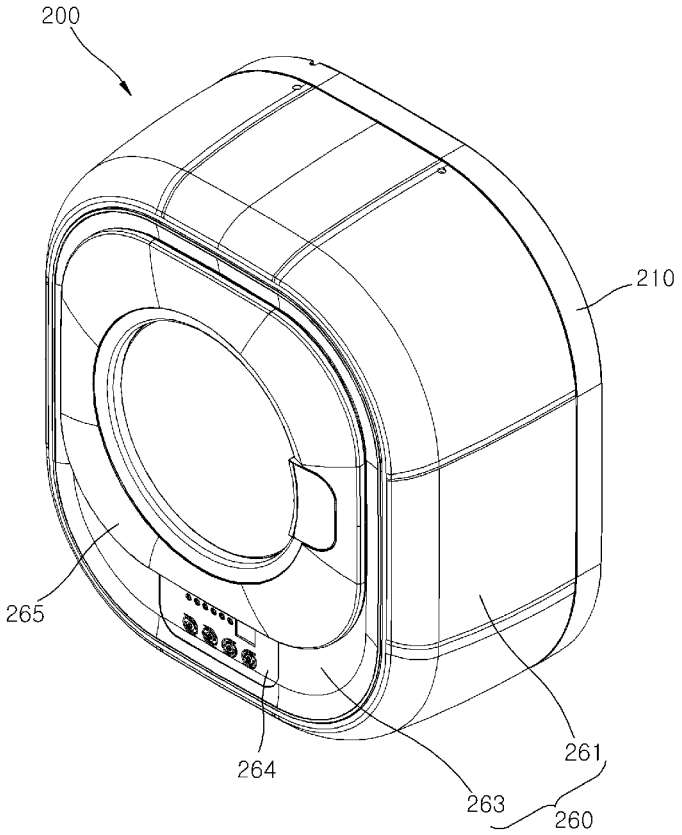
FIG. 2 is a perspective view of a wall-mounted drum washing machine of the wall-mounted drum washing apparatus in accordance with the first embodiment of the present invention, when seen from the front side.
Figure 3:
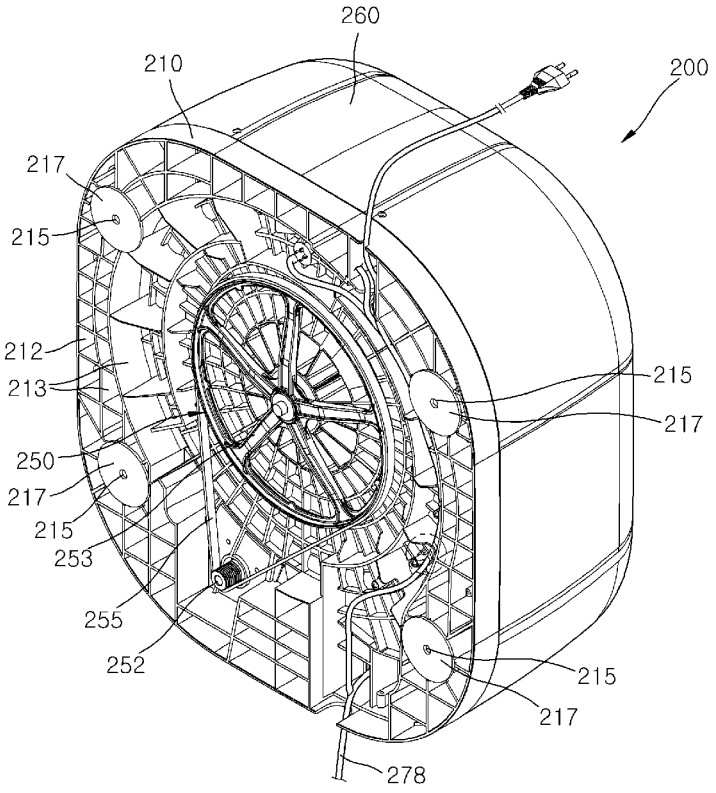
FIG. 3 is a perspective view of the wall-mounted drum washing machine of the wall-mounted drum washing apparatus in accordance with the first embodiment of the present invention, when seen from the rear side.
Figure 4:
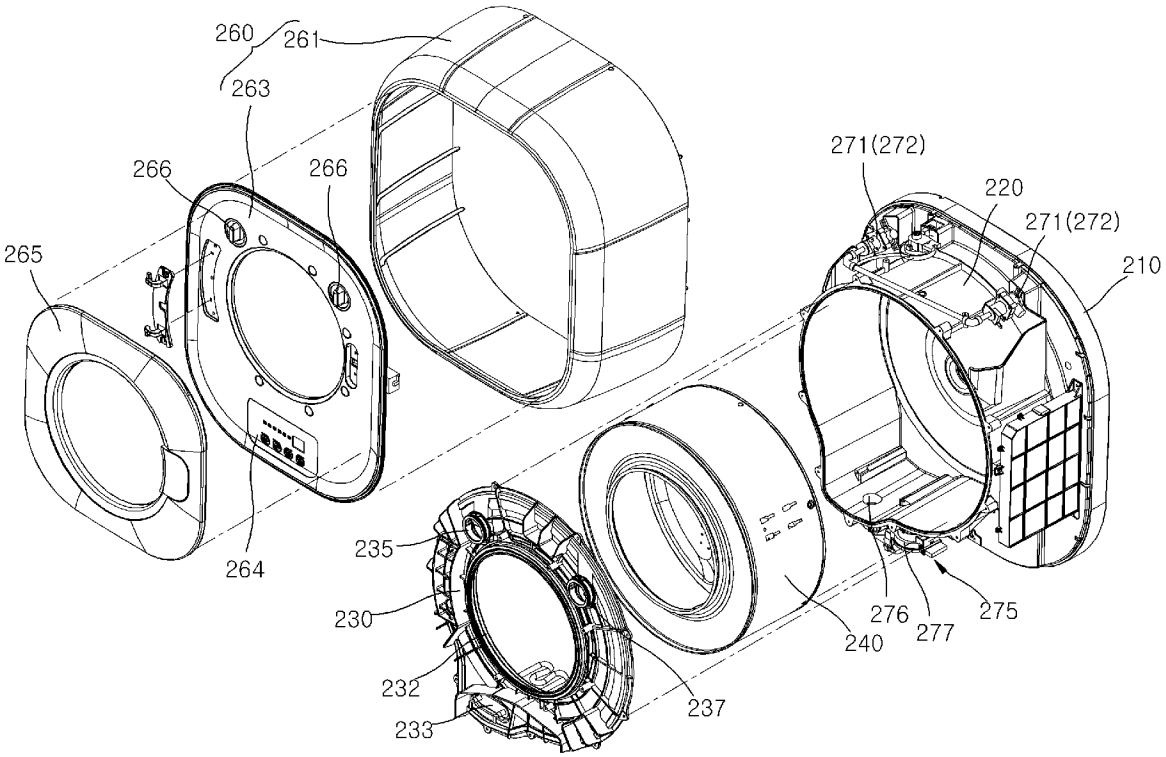
FIG. 4 is an exploded perspective view of the wall-mounted drum washing machine of the wall-mounted drum washing apparatus in accordance with the first embodiment of the present invention.
Figure 5:
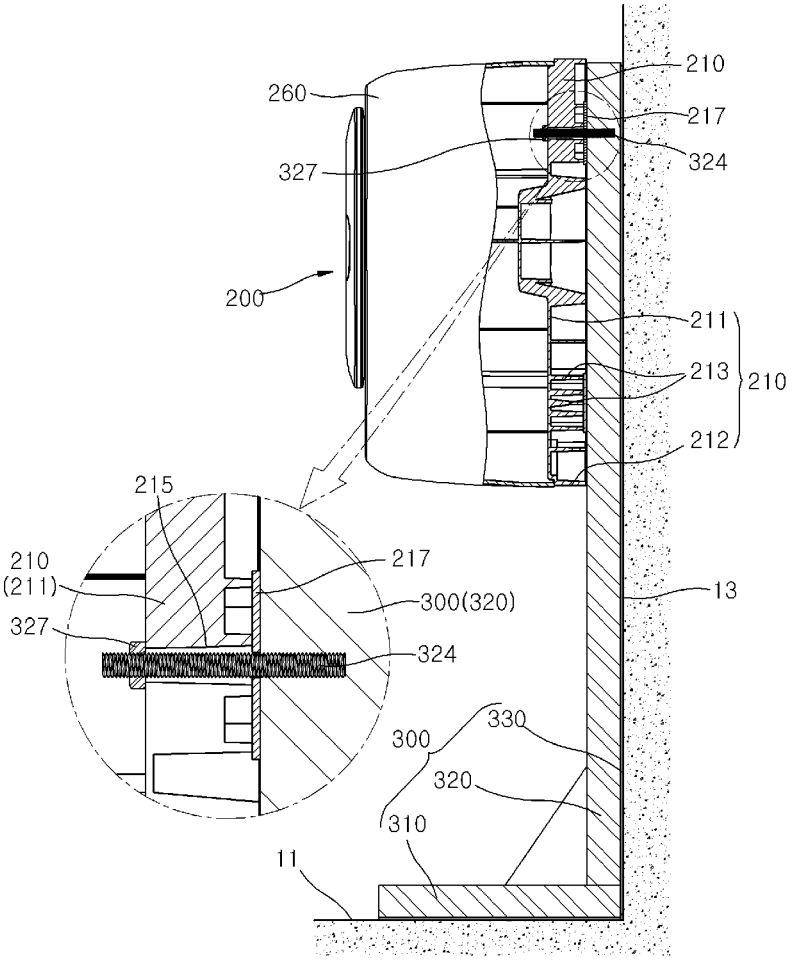
FIG. 5 is a cross-sectional view of the wall-mounted drum washing machine of the wall-mounted drum washing apparatus in accordance with the first embodiment of the present invention.
Figure 6:
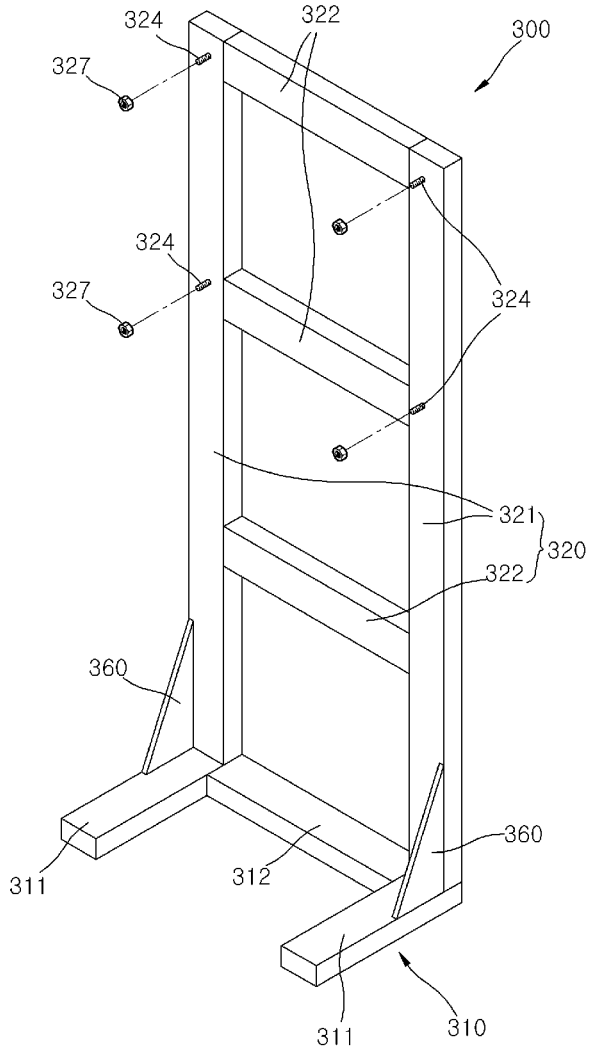
FIG. 6 is a perspective view of an installation stand of the wall-mounted drum washing apparatus in accordance with the first embodiment of the present invention, when seen from the front side.
Figure 7:
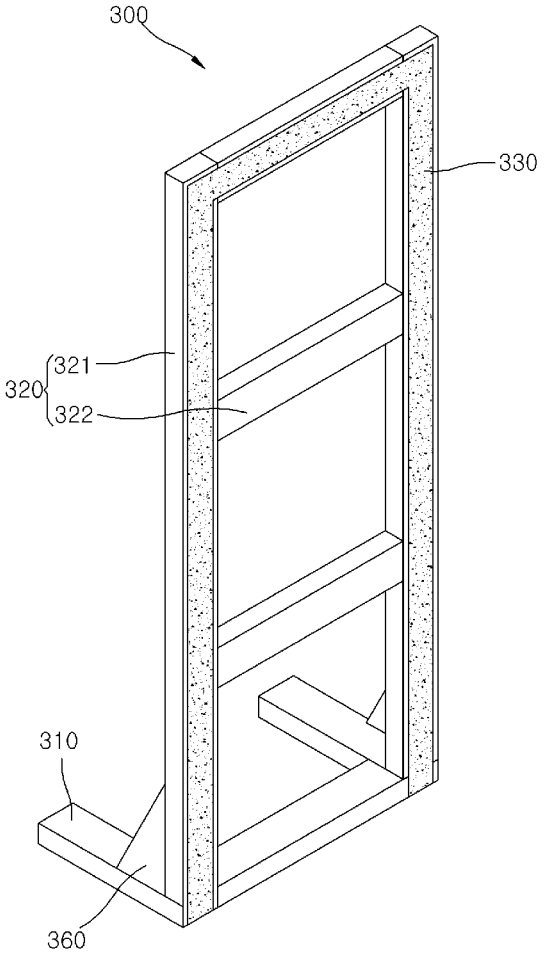
FIG. 7 is a perspective view of the installation stand of the wall-mounted drum washing apparatus in accordance with the first embodiment of the present invention, when seen from the rear side.
Figure 8:
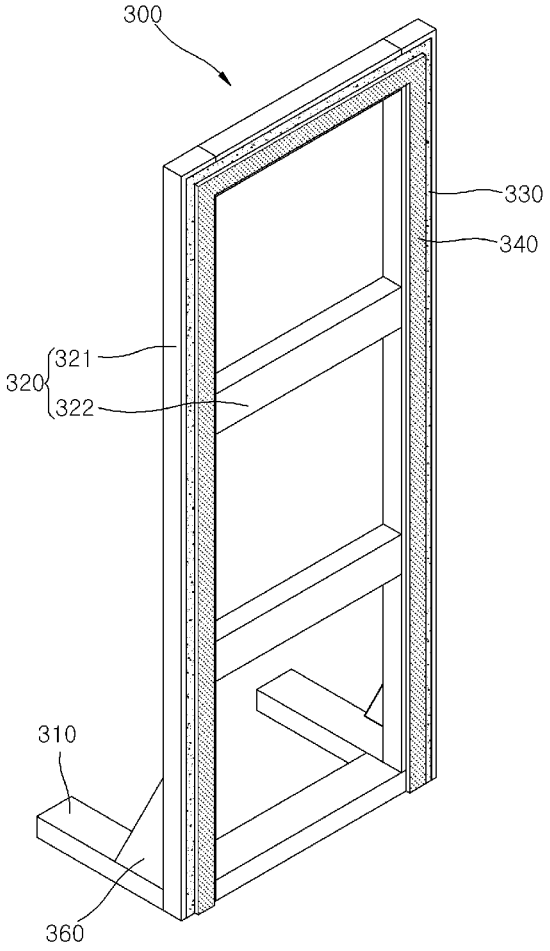
FIG. 8 is a perspective view illustrating a state in which a buffer member is coupled to the installation stand of the wall-mounted drum washing apparatus in accordance with the first embodiment of the present invention.

FIG. 1 is a perspective view illustrating an installation state of a wall-mounted drum washing apparatus in accordance with a first embodiment of the present invention. FIG. 2 is a perspective view of a wall-mounted drum washing machine of the wall-mounted drum washing apparatus in accordance with the first embodiment of the present invention, when seen from the front side. FIG. 3 is a perspective view of the wall-mounted drum washing machine of the wall-mounted drum washing apparatus in accordance with the first embodiment of the present invention, when seen from the rear side. FIG. 4 is an exploded perspective view of the wall-mounted drum washing machine of the wall-mounted drum washing apparatus in accordance with the first embodiment of the present invention. FIG. 5 is a cross-sectional view of the wall-mounted drum washing machine of the wall-mounted drum washing apparatus in accordance with the first embodiment of the present invention. FIG. 6 is a perspective view of an installation stand of the wall-mounted drum washing apparatus in accordance with the first embodiment of the present invention, when seen from the front side. FIG. 7 is a perspective view of the installation stand of the wall-mounted drum washing apparatus in accordance with the first embodiment of the present invention, when seen from the rear side. FIG. 8 is a perspective view illustrating a state in which a buffer member is coupled to the installation stand of the wall-mounted drum washing apparatus in accordance with the first embodiment of the present invention.

Referring to FIG. 1, the wall-mounted drum washing apparatus in accordance with the first embodiment of the present invention includes a wall-mounted drum washing machine 200 and an installation stand 300.

Referring to FIGS. 2 to 5, the wall-mounted drum washing machine 200 in accordance with the first embodiment of the present invention includes a rear panel 210, a tub 220, a drum 240, a driving unit 250, a front panel 230, a cover 260, a water supply device 271, and a drain device 275.

The rear panel 210 having a panel shape is mounted and fixed on the installation stand 300.

In the present embodiment, the rear panel 210 has a rectangular panel shape of which the corners are rounded, but is not limited thereto. Thus, the rear panel 210 may be formed in various shapes such as circular shape or elliptical shape.

The rear panel 210 includes a panel portion 211, a circumference portion 212, and a rib portion 213.

The panel portion 211 has a panel shape extending in parallel to an upper support portion 320 of the installation stand 300.

The circumference portion 212 is formed to protrude toward the wall from the edge of the panel portion 211, and a space is formed between the panel portion 211 and the upper support portion 320 of the installation stand 300 by the circumference portion 212.

The rib portion 213 includes a plurality of ribs formed on the rear surface of the panel portion 211 in the space formed between the panel portion 211 and the upper support portion 320 of the installation stand 300.

Since the strength of the rear panel 210 is reinforced by the rib portion 213, the rear panel 210 is prevented from being deformed or broken by vibrations generated through rotations of the drum 240.

The rear panel 210 has a through-hole 215 through which a fixing anchor 324 coupled to the upper support portion 320 of the installation stand 300 is inserted, and a buffer member 217 is interposed between the through-hole 215 and the installation stand 300.

The front side of the rear panel 210 is formed in a rectangular shape or a similar shape to the rectangular shape, and the rear panel 210 includes a plurality of through-holes 215 formed at four corners thereof, respectively.

As the ends of the fixing anchors 324 protruding from the front side of the upper support portion 320 are inserted into the respective through-holes 215, the rear panel 210 is coupled to the upper support portion 320.

When a bolt member is applied as the fixing anchor 324, a nut member 327 may be coupled to the end of the fixing anchor 324 such that the rear panel 210 is stably attached and fixed to the upper support portion 320.

At this time, the nut member 327 is coupled to the fixing anchor 324 at the front side of the rear panel 210, and closely attached to the front surface of the rear panel 210.

During the operation of the wall-mounted drum washing machine 200, vibrations may be generated. The vibrations are transmitted through the nut member 327 which closely attaches the fixing anchor 324 and the rear panel 210.

Between the rear panel 210 and the upper support portion 320, the buffer member 217 is interposed to suppress the vibrations of the drum 240 from being transmitted to the upper support portion 320 of the installation stand 300.

The tub 220 is supported by the rear panel 210, and contains wash water.

In the present embodiment, the tub 220 having a cylindrical shape is integrally connected to the front surface of the rear panel 210, and formed to protrude toward the front side from the front surface of the rear panel 210.

The drum 240 having a cylindrical shape is rotatably installed in the tub 220, and houses laundry therein.

The drum 240 has a driving shaft 243 rotatably installed in the rear panel 210, and is connected to the driving unit 250 installed on the rear surface of the rear panel 210 through the panel portion 211.

The driving unit 250 provides power to the drum 240.

The driving unit 250 in accordance with the first embodiment of the present invention includes a motor, a driving wheel 253, and a belt 255.

The motor is installed on the front surface of the rear panel 210, and has a rotating shaft 252 extended to the rear surface of the rear panel 210 through the rear panel 210.

The driving wheel 253 is rotatably installed on the rear surface of the panel portion 211 in the space formed at the rear side of the panel portion 211, and connected to the driving shaft 243 of the drum 240.

The belt 255 transmits the power of the motor to the driving wheel 253.

One side of the belt 255 is wound around the circumference of the rotating shaft 252 of the motor, and the other side of the belt 255 is wound around the circumference of the driving wheel 253.

As the motor is driven, the torque of the motor is transmitted to the driving wheel 253 through the belt 255, and the drum 240 connected to the driving wheel 253 is rotated to perform a washing operation.

The front panel 230 has an opening 232 formed at a position corresponding to an opening of the tub 220 and is installed at the front surface of the tub 220.

The rear panel 230 includes a control unit 233 installed at the bottom thereof and a detergent box 235 and a conditioner box 237 installed at the top thereof.

The control unit 233 is connected to a manipulation unit 264 formed in a cover unit 263 of the cover 260, and controls water supply, drainage, spin-drying, or rotation of the drum 240 according to a manipulation for the manipulation unit 264.

The cover 260 is installed on the rear panel 210 so as to cover the tub 220 and the front panel 230, thereby constituting the exterior of the wall-mounted drum washing machine 200 in accordance with the embodiment of the present invention.

The cover 260 in accordance with the embodiment of the present invention includes a box unit 261 and the cover unit 263.

The box unit 261 is installed on the rear panel 210, and covers the circumference of the tub 220.

The cover unit 263 is coupled to the front surface of the box unit 261 so as to cover the front panel 230, and a door 265 is installed at a position corresponding to the opening 232.

The cover unit 263 includes the manipulation unit 264 formed at the bottom thereof. The manipulation unit 264 includes manipulation buttons, a number display device and the like, and is connected to the control unit 233.

At the top of the cover unit 263, a cap 266 is installed at a position corresponding to each of the detergent box 235 and the conditioner box 237.

When the cap 266 is separated from the cover unit 263, the detergent box 235 or the conditioner box 237 may be taken out of the front panel 230 or inserted into the front panel 230.

The water supply device 271 is coupled to the upper part of the rear panel 210, and supplies wash water into the tub 220.

The water supply device 271 in accordance with the embodiment of the present invention includes a water supply valve 272 and a water supply pipe (not illustrated).

The water supply valve 272 controls the flow rate of wash water supplied into the tub 220 through the water supply pipe.

One side of the water supply valve 272 is coupled to the upper part of the rear panel 210 and connected to the water supply pipe, and the other side of the water supply valve 272 is coupled to the tub 220 so as to supply wash water received through the water supply pipe into the tub 220.

The water supply pipe is inserted into the circumference portion 212 from a water supply source outside the wall-mounted drum washing machine 200, and extended to the upper part of the rear panel 210 so as to be connected to the water supply valve 272.

The drain device 275 discharges wash water from the tub 220 to the outside of the wall-mounted drum washing machine 200 in accordance with the embodiment of the present invention. More specifically, the drain device 275 discharges wash water to the outside of the cover 260 or the rear panel 210.

The drain device 275 in accordance with the embodiment of the present invention includes a drain hole 276, a drain pump 277, and a drain pipe 278.

The drain hole 276 is formed at the bottom of the tub 220, and the wash water contained in the tub 220 is discharged to the outside of the tub 220 through the drain hole 276.

The drain pump 277 is installed at the bottom of the tub 220 at a position corresponding to the drain hole 276.

The top of the drain pump 277 is coupled to the bottom of the tub 220 so as to communicate with the drain hole 276, and a rear end of the drain pump 277 facing the rear panel 210 is connected to the drain pipe 278.

The drain pipe 278 is connected to the drain pump 277, and extended to the outside of the wall-mounted drum washing machine 200 through the rear panel 210.

When the drain pump 277 is operated, the wash water contained in the tub 220 is forcibly discharged toward the drain pipe 278 through the drain hole 276. When the drain pump 277 is not operated, the discharge of the wash water is stopped.

Referring to FIGS. 1 and 5 to 8, the installation stand 300 is formed to extend upward from a floor 11 of a structure where the wall-mounted drum washing machine 200 is installed. At this time, the installation stand 300 is disposed in contact with the floor 11 and the wall 13, and the wall-mounted drum washing machine 200 is mounted on the installation stand 300.

The installation stand 300 in accordance with the first embodiment of the present invention includes a lower support portion 310 and the upper support portion 320. The lower support portion 310 is placed on the floor 11 so as to be contacted with the floor 11, and the upper support portion 320 is contacted with the wall 13.

The lower support portion 310 includes a pair of bar-shaped frame members 311 and a central member 312. The frame members 311 are disposed to be separated from each other, and the central member 312 connects the frame members 311.

The pair of frame members 311 are installed in contact with the floor 11, and fixed to the floor 11. The pair of frame member 311 may be disposed in parallel to each other. One end of the central member 312 is connected to one frame member 311, and the other end of the central member 312 is connected to the other frame member 311 so as to connect the pair of frame members 311.

The upper support portion 320 is connected to an end of the lower support portion 310, extended upward in parallel to the wall 13, and fixed in a state where the upper support portion 320 is contacted with the wall 13. The wall-mounted drum washing machine 200 is mounted on the upper support portion 320.

Since the lower end of the upper support portion 320 disposed in contact with the wall 13 is connected to the lower support portion 310, the contact state between the upper support portion 320 and the wall 13 may be maintained. That is, since the lower support portion 310 serves as a support of the upper support portion 320, the upper support portion 320 may be supported in a state where the upper support portion 320 is contacted with the wall 13. Thus, although the wall-mounted drum washing machine 200 having a large weight is mounted on the upper support portion 320, the movement of the upper support portion 320 may be blocked. Therefore, the wall-mounted drum washing machine 200 may be reliably fixed on the installation stand 300.

Referring to FIG. 6, the fixing anchors 324 to be coupled to the wall-mounted drum washing machine 200 are formed to protrude from the front surface of the upper support portion 320, which is contacted with the wall-mounted drum washing machine 200.

The ends of the fixing anchors 324 protruding to the front side of the upper support portion 320 are inserted into the through-holes 215 of the rear panel 210. The front ends of the fixing anchors 324, or specifically, the front ends of the fixing anchors 324 positioned at the front side of the rear panel 210 through the through-holes 215 are coupled to the nut members 327. Thus, since the rear panel 210 is prevented from coming off from the fixing anchors 324, the wall-mounted drum washing machine 200 may be reliably mounted on the installation stand 300.

The buffer member 217 is interposed between the rear panel 210 and the upper support portion 320. Thus, the vibrations generated by the rotations of the drum 240 may be blocked from being transmitted to the upper support portion 320.

The upper support portion 320 includes a pair of vertical bars 321 and a plurality of connection bars 322.

The vertical bars 321 have a bar shape extended upward, and are disposed in contact with the wall 13. The bottoms of the vertical bars 321 are connected to the lower support portion 310. The pair of vertical bars 321 are disposed to be separated from each other, and disposed in parallel to each other.

The plurality of connection bars 322 connect the pair of vertical bars 321, and are disposed to be separated from each other along the extension direction of the vertical bars 321.

One ends of the connection bars 322 are coupled to one vertical bar 321, and the other ends of the connection bars 322 are coupled to the other vertical bar 321. Thus, the connection bars 322 support the vertical bars 321 in the side-to-side direction.

The installation stand 300 may be made of wood, metal, or plastic. The installation stand 300 may be fixed to the floor 11 and the wall 13 through an adhesive member, such as structural adhesive, epoxy, silicone, or adhesive tape, in a state where the installation stand 300 is contacted with the floor 11 and the wall 13.

Referring to FIG. 7, an adhesive coupling layer 330 may be additionally formed on the bottom surface of the lower support portion 310, which is contacted with the floor 11, and the rear surface of the upper support portion 320, which is contacted with the wall 13.

Since the adhesive coupling layer 330 has an adhesive surface, the adhesive member may be stably attached to the adhesive coupling layer 330. Thus, the adhesive member may be attached to the bottom surface and the rear surface of the installation stand 300, and the installation stand 300 may be fixed to the floor 11 and the wall 13 through the adhesive member in a state where the installation stand 300 is contacted with the floor 11 and the wall 13.

The adhesive coupling layer 330 may be formed by applying synthetic resin paint onto the bottom surface of the bottom support portion 310 and the rear surface of the upper support portion 320 or formed by bonding a synthetic resin film.

When the adhesive coupling layer 330 is formed on the installation stand 300, the installation stand 300 may be reliably fixed to the floor 11 and the wall 13 through the adhesive member, regardless of the properties of the material forming the installation stand 300, such as water content and surface roughness. For example, the properties may include the quality of wood, a density difference and the like.

Referring to FIG. 8, a buffer member 340 may be additionally coupled to the rear surface of the upper support portion 320 contacted with the wall 13. The buffer member 340 serves to absorb the vibrations generated from the wall-mounted drum washing machine 200.

When the wall-mounted drum washing machine 200 is operated, the vibrations generated by the rotations of the drum 240 are primarily reduced by the buffer member 217 interposed between the rear panel 210 and the upper support portion 320, and secondarily reduced by the buffer member 340 interposed between the upper support portion 320 and the wall 13.

As the vibrations generated by the operation of the wall-mounted drum washing machine 200 are blocked from being transmitted to the wall 13, noise may be reduced.

A bracket 360 has a cross-section formed in an L-shape or right-angled triangle shape which has a length in the vertical and horizontal directions. As the bracket 360 is additionally coupled to a connection between the lower support portion 310 and the upper support portion 320, the coupling strength between the lower support portion 310 and the upper support portion 320 may be reinforced.

Thus, the upper support portion 320 on which the wall-mounted drum washing machine 200 is mounted may be blocked from being separated from the wall 13 and inclined to the front side.

Figure 9:
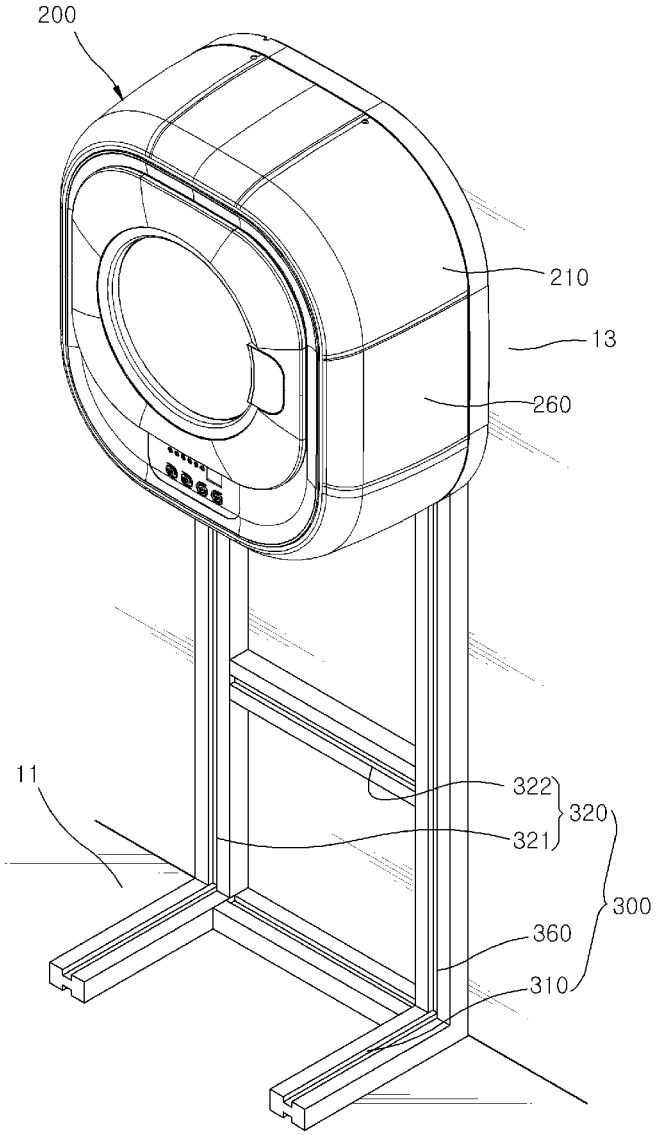
FIG. 9 is a perspective view illustrating an installation state of a wall-mounted drum washing apparatus in accordance with a second embodiment of the present invention.
Figure 10:
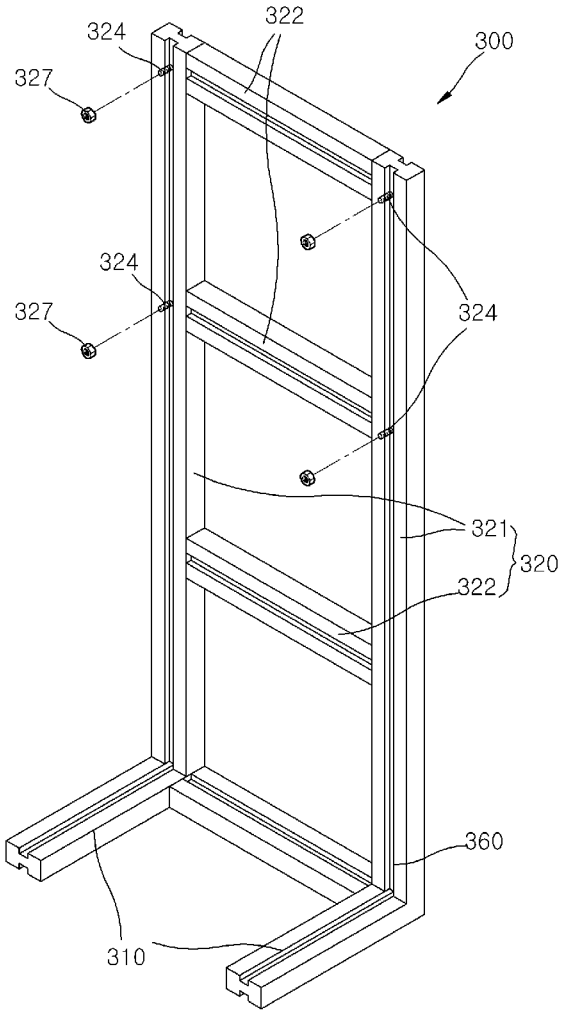
FIG. 10 is a perspective view of an installation stand of the wall-mounted drum washing apparatus in accordance with the second embodiment of the present invention, when seen from the front side.
Figure 11:
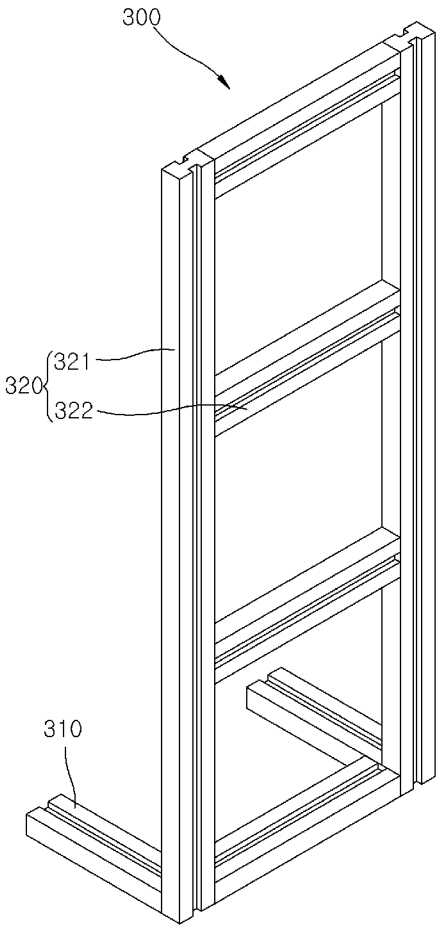
FIG. 11 is a perspective view of the installation stand of the wall-mounted drum washing apparatus in accordance with the second embodiment of the present invention, when seen from the rear side.

FIG. 9 is a perspective view illustrating an installation state of a wall-mounted drum washing apparatus in accordance with a second embodiment of the present invention. FIG. 10 is a perspective view of an installation stand of the wall-mounted drum washing apparatus in accordance with the second embodiment of the present invention, when seen from the front side. FIG. 11 is a perspective view of the installation stand of the wall-mounted drum washing apparatus in accordance with the second embodiment of the present invention, when seen from the rear side.

In the wall-mounted drum washing apparatus of FIGS. 9 to 11 in accordance with the second embodiment of the present invention, a metallic frame is applied as the material of the installation stand 300.

The wall-mounted drum washing apparatus in accordance with the second embodiment of the present invention may include the same components as described in the first embodiment of the present invention. The detailed descriptions of the components are omitted herein.

The installation stand 300 in accordance with the second embodiment of the present invention is formed by connecting a plurality of metallic frames to each other. The plurality of metallic frames are formed in a straight bar shape, and have a cross-section formed in an H-shape in which the middle portions thereof are depressed in a thickness direction.

The installation stand 300 includes a lower support portion 310 and an upper support portion 320, and the upper support portion 320 includes a pair of vertical bars 321 and a plurality of connection bars 322.

The installation stand 300 may be reliably formed by connecting a plurality of metallic frames through bolt members, the plurality of metallic frames having a straight bar shape and constituting the lower support portion 310, the vertical bars 321, and the connection bars 322, respectively.

Figure 12:
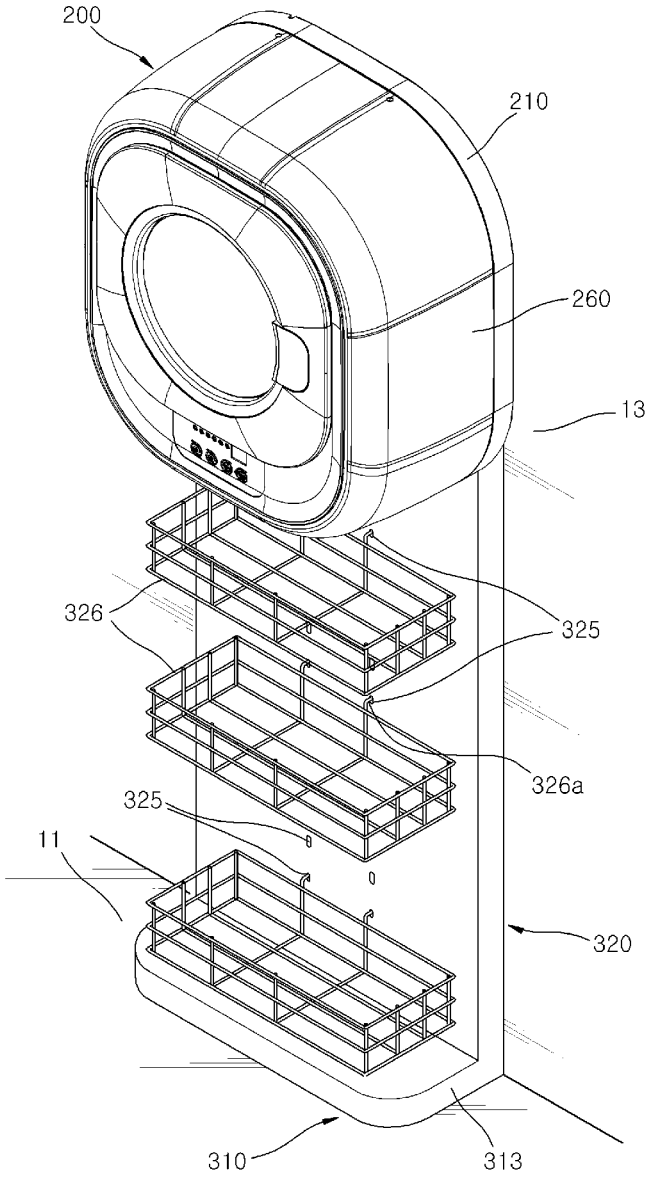
FIG. 12 is a perspective view illustrating an installation state of a wall-mounted drum washing apparatus in accordance with a third embodiment of the present invention.
Figure 13:
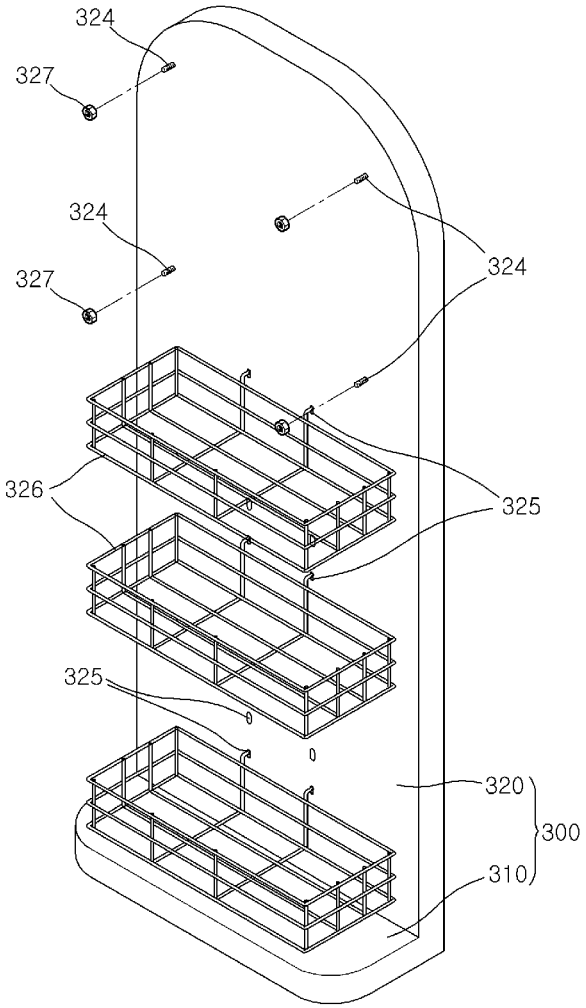
FIG. 13 is a perspective view of the installation stand of the wall-mounted drum washing apparatus in accordance with the third embodiment of the present invention, when seen from the front side.
Figure 14:
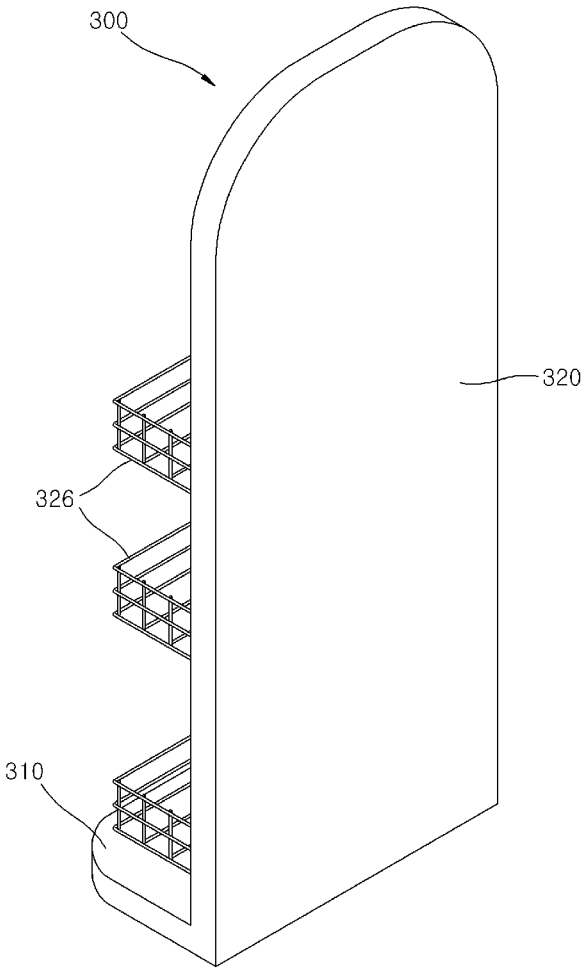
FIG. 14 is a perspective view of the installation stand of the wall-mounted drum washing apparatus in accordance with the third embodiment of the present invention, when seen from the rear side.

FIG. 12 is a perspective view illustrating an installation state of a wall-mounted drum washing apparatus in accordance with a third embodiment of the present invention. FIG. 13 is a perspective view of the installation stand of the wall-mounted drum washing apparatus in accordance with the third embodiment of the present invention, when seen from the front side. FIG. 14 is a perspective view of the installation stand of the wall-mounted drum washing apparatus in accordance with the third embodiment of the present invention, when seen from the rear side.

In the wall-mounted drum washing apparatus of FIGS. 12 to 14 in accordance with the third embodiment of the present invention, a panel member is used as the installation stand 300, unlike the first and second embodiments of the present invention.

The installation stand 300 in accordance with the third embodiment of the present invention includes a lower support portion 310 and an upper support portion 320, which are contacted with a floor 11 and a wall 13, respectively.

The lower support portion 310 includes a frame member having a panel shape (hereafter, referred to as 'lower support panel 313'). The lower support panel 313 is installed in contact with the floor 11, and extended in parallel to the floor 11 so as to be contacted with the floor 11 in a wide area.

The upper support portion 320 includes a frame member having a panel shape (hereafter, referred to as 'upper support panel 323'). The bottom of the upper support panel 323 is connected to the lower support panel 313, and the upper support panel 323 is installed in contact with the wall 13 and supported by the wall 13.

The installation stand 300 in accordance with the third embodiment of the present invention may be fixed in a state where the lower support panel 313 and the upper support panel 323 are contacted with the floor 11 and the wall 13, respectively, through an adhesive member, like the installation stands 300 in accordance with the first and second embodiments.

In the installation stand 300 in accordance with the third embodiment of the present invention, the contact area between the installation stand 300 and the floor 11 and the contact area between the installation stand 300 and the wall 13 may be expanded more than in the first and second embodiments including the bar-shaped frame members. Thus, the installation stand 300 may be more stably fixed on a structure. In this case, the installation stability of the wall-mounted drum washing machine 200 mounted on the installation stand 300 may be secured.

When the installation stand 300 in accordance with the third embodiment of the present invention is applied, the contact area between the lower support portion 310 and the upper support portion 320 may also be further expanded. Thus, the lower support portion 310 and the upper support portion 320 may be more reliably coupled to each other.

Referring to FIG. 13, the upper support portion 320 in accordance with the third embodiment of the present invention includes a plurality of coupling grooves 325 and a plurality of trays 326.

Each of the coupling grooves 325 is formed in a concave shape in the upper support panel 323. The coupling groove 325 may be set to such a size that a ring portion **326*a* formed at an end of the tray 326 is inserted and fixed to the coupling groove 325. As illustrated in FIG. 13, the coupling groove 325 not only may be formed in a concave shape, but also may be formed in a hole shape passing through the upper support panel 323**.

The tray 326 may be used as a container for containing laundry or detergent, and the structure and shape of the tray 326 are not limited as long as the tray 326 may contain laundry or detergent.

The plurality of coupling grooves 325 may be successively formed in a vertical direction over the upper support panel 323. Thus, a user may designate coupling grooves 325 to which the ring portions **326*a* of the tray 326 are coupled, and may install the tray 326 at a desired position over the upper support panel 323**.

Furthermore, since a plurality of trays 326 may be simultaneously stalled over the upper support panel 323, the amount of laundry or detergent housed in the tray 326 may be increased.

Figure 15:
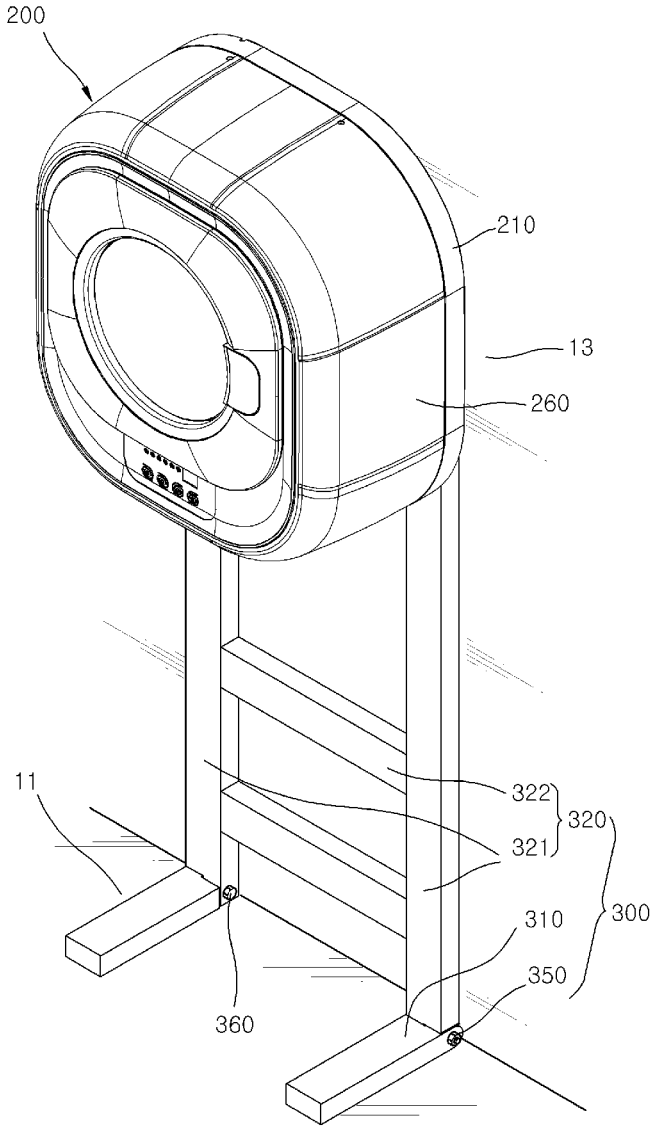
FIG. 15 is a perspective view of a wall-mounted drum washing apparatus in accordance with a fourth embodiment of the present invention.
Figure 16:
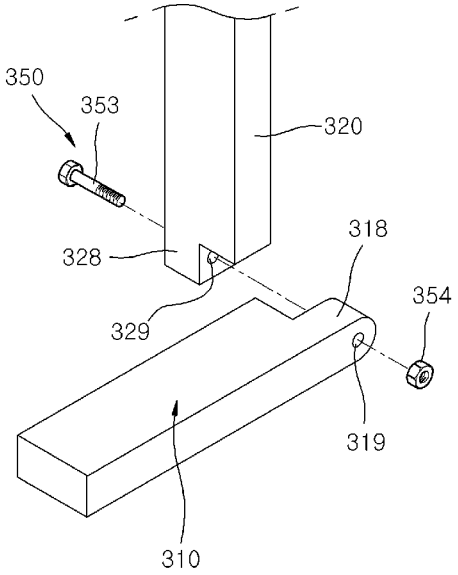
FIG. 16 is an exploded perspective view of main parts of the wall-mounted drum washing apparatus in accordance with the fourth embodiment of the present invention.
Figure 17:
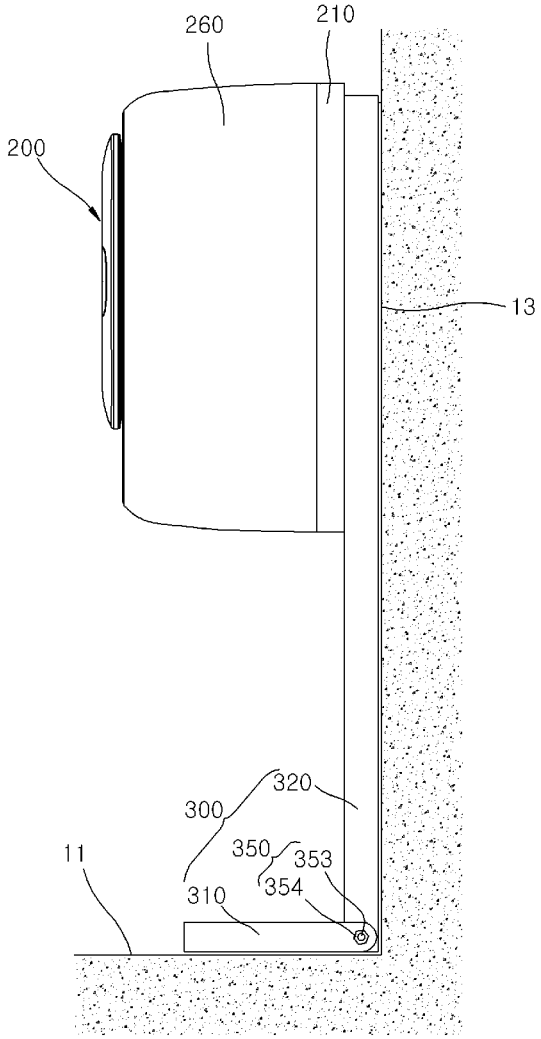
FIG. 17 is a conceptual view for explaining an example of an installation state of the wall-mounted drum washing apparatus in accordance with the fourth embodiment of the present invention.
Figure 18:
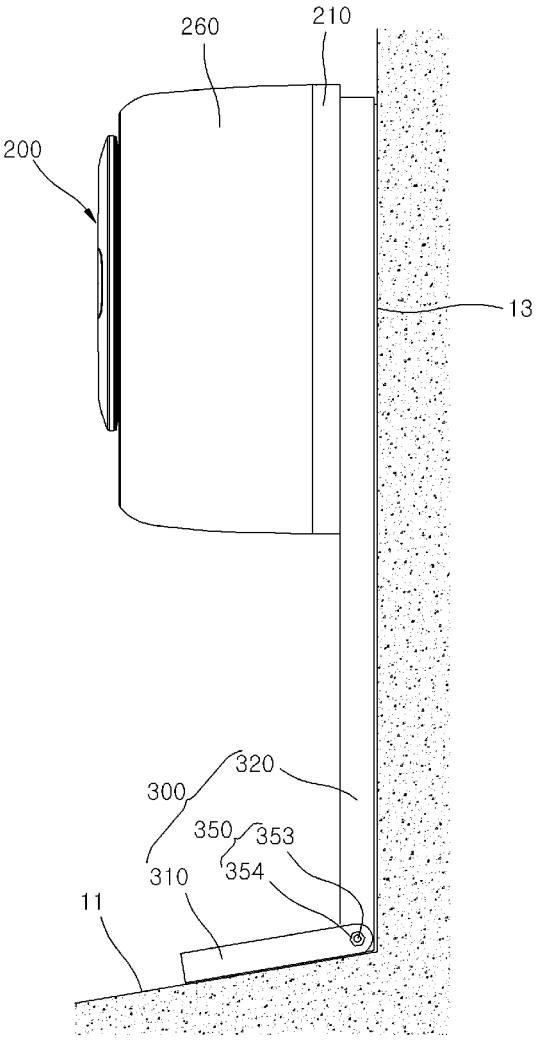
FIG. 18 is a conceptual view for explaining another example of an installation state of the wall-mounted drum washing apparatus in accordance with the fourth embodiment of the present invention.

FIG. 15 is a perspective view of a wall-mounted drum washing apparatus in accordance with a fourth embodiment of the present invention. FIG. 16 is an exploded perspective view of main parts of the wall-mounted drum washing apparatus in accordance with the fourth embodiment of the present invention. FIG. 17 is a conceptual view for explaining an example of an installation state of the wall-mounted drum washing apparatus in accordance with the fourth embodiment of the present invention. FIG. 18 is a conceptual view for explaining another example of an installation state of the wall-mounted drum washing apparatus in accordance with the fourth embodiment of the present invention.

The installation stand 300 of FIGS. 15 to 18 in accordance with the fourth embodiment of the present invention includes an angle control unit 350 for controlling an angle between a lower support portion 310 and an upper support portion 320 according to the gradient of a floor 11, unlike the first and second embodiments of the present invention.

The angle control unit 350 includes a hinge pin 353 and a fixing member 354.

The upper support portion 320 has an upper protrusion 328 formed at the bottom thereof. The upper protrusion 328 has an upper through-hole 329 through which the hinge pin 353 passes.

The upper protrusion 328 is contacted with a lower protrusion 318 of the lower support portion 310 at a surface where the upper through-hole 329 is formed.

The lower support portion 310 has the lower protrusion 318 formed at an end thereof. The lower protrusion 318 has a lower through-hole 319 through which the hinge pin 353 passes. The lower protrusion 318 is contacted with the upper protrusion 328 at a surface where the lower through-hole 319 is formed.

When the upper protrusion 328 and the lower protrusion 318 are in contact with each other, the upper through-hole 329 and the lower through-hole 319 are disposed to overlap each other. Thus, when the hinge pin 353 is sequentially passed through the upper through-hole 329 and the lower through-hole 319, the upper protrusion 328 and the lower protrusion 318 are coupled through the hinge pin 353.

An end of the hinge pin 353, or specifically, an end of the hinge pin 353 which passes through the upper through-hole 329 and the lower through-hole 319 is coupled to a fixing member 354. Thus, since the hinge pin 353 may be blocked from coming off from the upper through-hole 329 or the lower through-hole 319, the coupling between the upper support portion 320 and the lower support portion 310 may be maintained.

When a bolt member is applied as the hinge pin 353, a nut member may be used as the fixing member 354 to closely attach the hinge pin 353 to the upper support portion 320 and the lower support portion 310.

A floor 11 of a bathroom, a utility room, a veranda or the like where water is used may be formed to be inclined downward to a drain hole. Thus, the floor 11 has a different gradient depending on places.

When the angle control unit 350 is provided as illustrated in FIGS. 17 and 18, the angle between the lower support portion 310 and the upper support portion 320 may be controlled in various manners according to the gradient of the floor 11.

That is, when the fixing member 354 is coupled to the hinge pin 353 after the angle between the lower support portion 310 and the upper support portion 320 is controlled in a state where the fixing member 354 is separated from the hinge pin 353, the lower support portion 310 and the upper support portion 320 may maintain a predetermined angle.

Since the angle between the lower support portion 310 and the upper support portion 320 may be immediately controlled according to the gradient of the floor 11 on which the installation stand 300 is to be installed, the lower support portion 310 may be closely attached to the floor 11, and the upper support portion 320 may be closely attached to the wall 13.

Thus, it is possible to prevent the lower support portion 310 from being separated from the floor 11 in a state in where the upper support portion 320 is fixed to the wall 13. Furthermore, it is possible to prevent the upper support portion 320 from being separated from the wall 13 so as not to be supported by the wall 13 in a state where the lower support portion 310 is closely attached to the floor 11.

In accordance with the embodiments of the present invention, since the wall-mounted drum washing machine is mounted on the installation stand and the installation stand is disposed in contact with the floor and the wall, the wall-mounted drum washing machine may be reliably fixed on the installation stand.

Furthermore, as the installation stand includes the adhesive coupling layer, the installation stand may be fixed in a state in which the installation stand is contacted with the floor and the wall through the adhesive member attached to the adhesive coupling layer.

Furthermore, as the buffer member is interposed between the upper support portion and the wall, the vibrations generated by the operation of the wall-mounted drum washing machine may be suppressed from being transmitted to the wall. Thus, noise may be reduced.

Furthermore, as the installation stand includes the angle control unit, the angle between the lower support portion and the upper support portion may be controlled according to the gradient of the floor on which the installation is to be installed. Therefore, the lower support portion and the upper support portion may be closely attached to the floor and the wall.

The embodiments of the present invention have been disclosed above for illustrative purposes. Those skilled in the art will appreciate that various modifications, additions and substitutions are possible, without departing from the scope and spirit of the invention as disclosed in the accompanying claims.

What is claimed is:

1. A wall-mounted drum washing apparatus comprising:

a wall-mounted drum washing machine; and an installation stand formed to extend upward from a floor and contacted with the floor and a wall, wherein the wall-mounted drum washing machine is mounted on the installation stand, wherein the wall-mounted drum washing machine comprises:

a rear panel configured to serve as a mounting member to fix the wall-mounted drum washing machine to the installation stand;

a tub integrally formed with the rear panel, having smaller diameter than that of the rear panel and containing wash water;

a drum rotatably installed in the tub;

a driving unit providing power to the drum;

a front panel having an opening formed therein and installed on the tub;

a cover installed on the rear panel and covering the tub and the front panel;

a water supply device supplying wash water to the tub; and a drain device discharging wash water from the tub to the outside, wherein the installation stand comprises:

a lower support portion contacted with the floor; and an upper support portion connected to the lower support portion, formed to extend upward from the lower support portion, and disposed in contact with the wall, and the wall-mounted drum washing machine is mounted on the upper support portion without contacting with the lower support portion, wherein the installation stand further comprises a buffer member coupled to one or more of a bottom surface of the lower support portion, which is contacted with the floor, and a rear surface of the upper support portion, which is contacted with the wall, and absorbing vibrations of the wall-mounted drum washing machine, and wherein the installation stand further comprises an adhesive coupling layer formed on one or more of a bottom surface of the lower support portion, which is contacted with the floor, and a rear surface of the upper support portion, which is contacted with the wall, and forming an adhesive surface on which an adhesive is attached, wherein the rear panel includes a panel portion, a circumference portion, and a rib portion, wherein the panel portion has a panel shape extending in parallel to the upper support portion of the installation stand, wherein the circumference portion is formed to protrude toward the wall from the edge of the panel portion, and a space is formed between the panel portion and the upper support portion of the installation stand by the circumference portion, wherein the rib portion includes a plurality of ribs formed on the rear surface of the panel portion in the space formed between the panel portion and the upper support portion of the installation stand, wherein the rear panel has a through-hole through which a fixing anchor coupled to the upper support portion of the installation stand is inserted, and a buffer member is interposed between the through-hole and the installation stand, wherein as the ends of the fixing anchors protruding from the front side of the upper support portion are inserted into the respective through-holes, the rear panel is coupled to the upper support portion.

2. The wall-mounted drum washing apparatus of claim 1, wherein the upper support portion comprises:

a plurality of vertical bars connected to the lower support portion at the bottom thereof and formed to extend upward; and a plurality of connection bars connecting the plurality of vertical bars.

3. The wall-mounted drum washing apparatus of claim 1, wherein the upper support portion comprises an upper support panel connected to the lower support portion at the bottom thereof and formed to extend upward.

4. The wall-mounted drum washing apparatus of claim 3, wherein the upper support portion comprises:

a plurality of coupling grooves formed in a concave shape in the upper support panel; and a tray inserted and coupled to a part of the coupling grooves and containing laundry or detergent.

5. The wall-mounted drum washing apparatus of claim 4, wherein the plurality of coupling grooves are formed in a vertical direction over the upper support panel, and the tray is selectively inserted and coupled to a part of the plurality of coupling grooves such that an installation position of the tray is changed over the upper support panel.

6. The wall-mounted drum washing apparatus of claim 1, wherein the upper support portion comprises a fixing anchor formed to protrude from a front surface thereof, which is contacted with the wall-mounted drum washing machine, toward a front side and inserted into the rear panel of the wall-mounted drum washing machine.

7. The wall-mounted drum washing apparatus of claim 6, wherein a front end of the fixing anchor passing through the rear panel is coupled to a nut member, thereby fixing the wall-mounted drum washing machine on the installation stand.

8. The wall-mounted drum washing apparatus of claim 1, wherein the installation stand further comprises an angle control unit controlling an angle between the lower support portion and the upper support portion according to a gradient of a floor.

9. The wall-mounted drum washing apparatus of claim 8, wherein the angle control unit comprises:

a hinge pin installed through the lower support portion and the upper support portion; and a fixing member coupled to an end of the hinge pin and blocking the hinge pin from coming off from the lower support portion and the upper support portion.

* * * * *